US007284361B2

(12) United States Patent
Lau

(10) Patent No.: US 7,284,361 B2
(45) Date of Patent: Oct. 23, 2007

(54) VACUUM MACHINE FOR ZIPPER BAG

(75) Inventor: Tung Yan Lau, Hong Kong (CN)

(73) Assignee: Design Manufacture Limited, Hong Kong (CN)

( * ) Notice: Subject to any disclaimer, the term of this patent is extended or adjusted under 35 U.S.C. 154(b) by 11 days.

(21) Appl. No.: 11/174,377

(22) Filed: Jul. 5, 2005

(65) Prior Publication Data

US 2006/0174593 A1 Aug. 10, 2006

(30) Foreign Application Priority Data

Feb. 4, 2005 (CN) ..... 2005 2 0002122 U

(51) Int. Cl.
*B65B 31/06* (2006.01)

(52) U.S. Cl. ..... 53/512; 141/65; 417/411

(58) Field of Classification Search ..... 53/434, 53/512; 141/65; 417/411; *B65B 31/06*
See application file for complete search history.

(56) References Cited

U.S. PATENT DOCUMENTS 4,744,196 A * 5/1988 Gallo ..... 53/375.4
5,215,445 A * 6/1993 Chen ..... 417/411
5,287,680 A * 2/1994 Lau ..... 53/512
5,765,608 A * 6/1998 Kristen ..... 141/65
5,784,862 A * 7/1998 Germano ..... 53/512
5,938,410 A * 8/1999 Lee ..... 417/234
6,520,071 B1 * 2/2003 Lanza ..... 141/65
6,543,491 B1 * 4/2003 Chung ..... 141/65
6,971,417 B2 * 12/2005 Deni ..... 141/65
7,086,211 B2 * 8/2006 Bassett et al. ..... 53/512
2006/0137299 A1 * 6/2006 Huang ..... 53/512

OTHER PUBLICATIONS

Seal-it™ Model SI-200 (Battery Version), Weston Consumer Products, LLC., (C) 2005, http://westonproducts.com/PDF/BV-660-(SI-200)-Battery.pdf.*

* cited by examiner

*Primary Examiner*—Stephen F. Gerrity

(57) ABSTRACT

A vacuum machine for zipper a bag comprising a casing, a motor, vanes, a suction mouth, a suction opening, a vent, a power supply, a switch and so on, wherein the suction opening is disposed corresponding to the vanes; the suction mouth is of tubular shape and is exposed out of the casing, and the rear end of which connects to the suction opening, wherein it also comprises a clamping member that connects with the casing and surrounds a section of the suction mouth; a clamping gap is formed between the clamping member and the suction mouth; the clamping member comprises an upper clamping member and a lower clamping member which are disposed substantially parallel to each other, thereby forming a clamping gap opening, the width of which is between 2 mm and 5 mm. The vacuum machine is simple in structure, small in size, convenient for use, highly flexible and suitable for zipper bags of different sizes and types. It not only vacuums zipper bags, but also securely seals the zipping strips of zipper bags, thereby solving the problem of difficulty in sealing the zipping strips accurately.

11 Claims, 5 Drawing Sheets

VACUUM MACHINE FOR ZIPPER BAG

BACKGROUND OF THE INVENTION

The present invention relates to vacuum machines and more particularly pertains to a vacuum machine for zipper bag.

There are different types of zipper bags in the marketplace for general household food storage. The structure of these zipper bags can be divided into two types, namely the zipping strip type and the sliding tab type. The zipping strip type is disposed with zipping strips for sealing on the two inner surfaces of the zipper bag opening. The zipping strips are interlockable grooves and ridges corresponding to each other. Users may seal the zipper bag by lightly pressing the zipping strips to insert the ridges into the grooves. However, it is often difficult to press the zipping strips accurately with fingers, especially for zipper bags with relatively wide openings. Users usually cannot seal the whole bag openings and this causes leakage of substance inside and fails to attain the effect of sealing.

The sliding tab type zipper bag is also disposed with interlocking zipping strips on the upper inner surfaces of the bag opening, with a sliding tab provided in addition thereto. The sliding tab is usually like a clamp which clamps the zipping strips in its clamping gap. Users only need to slide the sliding tab along the bag opening and the sliding tab would press and seal the zipping strips, thereby achieving sealing. Although sliding tab type zipper bags can seal bag openings easily, most sliding tabs are primitive in their structure and become loose easily. They are therefore not suitable for prolonged repeated use.

Moreover, both zipping strip type and sliding tab type zipper bags fail to attain the effect of complete vacuum. This is particularly apparent when they are used for food storage. If there is plenty of air inside a zipper bag, food becomes oxidized and rotten easily and cannot be stored for a long period of time. Although there are vacuum machines for vacuum sealing of plastic packaging bags in the marketplace, these vacuum machines are usually of complex structure and are bulky in size, which are not suitable for general household use. Some zipper bags are disposed with unidirectional suction valves for the vacuuming function, but this increases production costs and lacks flexibility. If users need to use zipper bags of different sizes, they would need to buy extra vacuum zipper bags.

Chinese Utility Model Patent No. 02271835.4 discloses a micro vacuum machine which is small and light. It draws out air from a zipper bag through a cylindrical suction mouth inserted into the bag so as to attain the vacuuming effect. However, users still need to press the zipping strips of the zipper bag with their hands when using this vacuum machine, which fails to solve the problem of difficultly sealing the zipping strips accurately. Even if a sliding tab zipper bag is used, users have to remove the suction mouth and zip the sliding tab at exactly the same time. The time lag between the two actions may cause entrance of air into the zipper bag, thereby reducing the vacuuming effect.

BRIEF SUMMARY OF THE INVENTION

In view of the aforesaid disadvantages now present in the prior art, the object of the present invention is to provide a vacuum machine for zipper bag which is of simple structure, small size, convenient for use, highly flexible and suitable for zipper bags of different sizes and types. It not only vacuumes zipper bags, but also securely seals the zipping strips of zipper bags, thereby solving the problem of difficultly sealing the zipping strips accurately.

To attain this, the present invention generally comprises a casing, a motor, vanes, a suction mouth, a suction opening, a vent, a power supply, a switch and so on; the power supply, the motor and the switch are electrically connected; the vanes are fixed on a motor axis; the suction opening is disposed corresponding to the vanes; the suction mouth is of tubular shape and is exposed out of the casing, and the rear end of which connects to the suction opening, wherein it also comprises a clamping member that connects with the casing and surrounds a section of the suction mouth; a clamping gap is formed between the clamping member and the suction mouth; the clamping member comprises an upper clamping member and a lower clamping member which are disposed substantially parallel to each other, thereby forming a clamping gap opening, the width of which is between 2 mm and 5 mm. The width and length of the clamping gap are adapted to receive an average zipper bag, and the width and length of the clamping gap opening are adapted to press and seal the zipping strips of an average zipper bag.

The cross section of the suction mouth is of olive shape, so that the zipping strips can be easily pressed and sealed and that the gap between the zipping strips and the suction mouth can be reduced, thereby increasing the suction efficiency.

The diagonal joining the corners of the olive-shaped suction mouth is inclined at an angle of 45° to the horizon.

The clamping member extends from the casing along the tubular wall of the suction mouth and surrounds one of the olive-shaped corners of the suction mouth, and the clamping gap opening corresponds to the olive-shaped corner.

The clamping member movably connects to the casing and the clamping member can rotate corresponding to the casing so as to move towards or away from the suction mouth, thereby adjusting the width of the clamping gap. Users may move the clamping member away from the suction mouth to increase the width of the clamping gap, so as to insert the zipper bag mouth in between the suction mouth and the clamping member into the clamping gap.

The upper clamping member and the lower clamping member movably connect to the casing separately; the upper clamping member and the lower clamping member can rotate corresponding to the casing separately so as to move towards or away from the suction mouth, thereby adjusting the width of the clamping gap.

A handle is disposed on the clamping member; the handle connects to the upper clamping member and the lower clamping member; the handle connects to a pivot of the casing; the handle rotates corresponding to the casing on the pivot and actuates the upper clamping member and the lower clamping member to rotate simultaneously, so as to move towards or away from the suction mouth, thereby adjusting the width of the clamping gap.

A spring is disposed on the clamping member; the spring moves the clamping member away from the suction mouth when it is in a released state and moves the clamping member towards the suction mouth when it is in a compressed state.

The suction mouth is longer than the clamping gap.

The suction mouth movably connects to a suction tube; the length of the suction tube may vary with the size of the zipper bag. Preferably, the bottom of the suction tube is disposed near the bottom of the zipper bag, so as to facilitate suction of air from the bottom of the zipper bag, thereby attaining better vacuuming effect.

A plurality of ridges or grooves is disposed on the upper clamping member and the lower clamping member respectively on the sides facing the clamping gap opening, so as to prevent slipping and displacement of the zipper bag.

The power supply is dry batteries or rechargeable batteries. When the power supply is rechargeable batteries, the rechargeable batteries connect to a recharging plug, and a socket is disposed on the casing corresponding to the recharging plug.

To use the present invention, users may insert the suction mouth into one end of the zipper bag opening and ensure that the ends of the zipping strips of the bag opening is disposed inside the clamping gap opening. Then, turn on the switch to drive the motor to make the vanes rotate to proceed vacuuming. At the same time, pull the present invention in the direction towards the suction mouth and the clamping gap opening will press and seal the zipping strips. When the suction mouth reaches the other end of the bag opening, ensure that air inside the bag is all drawn out and then remove the suction mouth and press and seal the rest of the zipping strips.

DETAILED DESCRIPTION OF THE INVENTION

Figure 1:
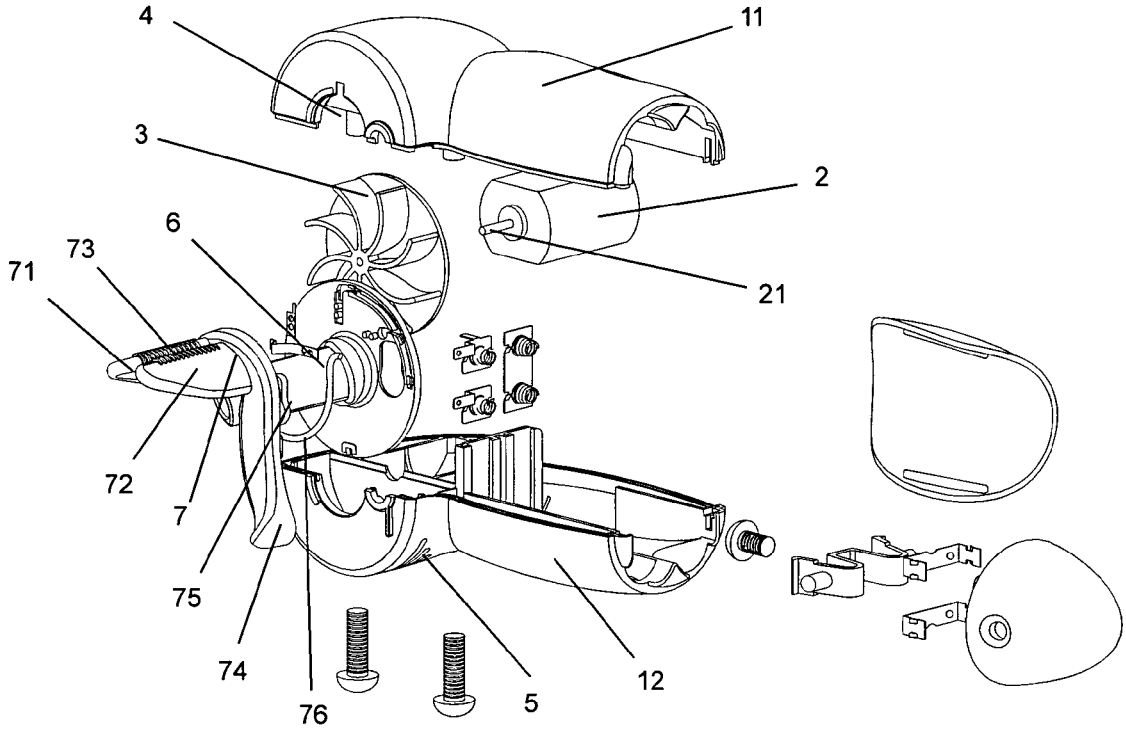
FIG. 1 shows the dismantling view of the first embodiment of the present invention.
Figure 4:
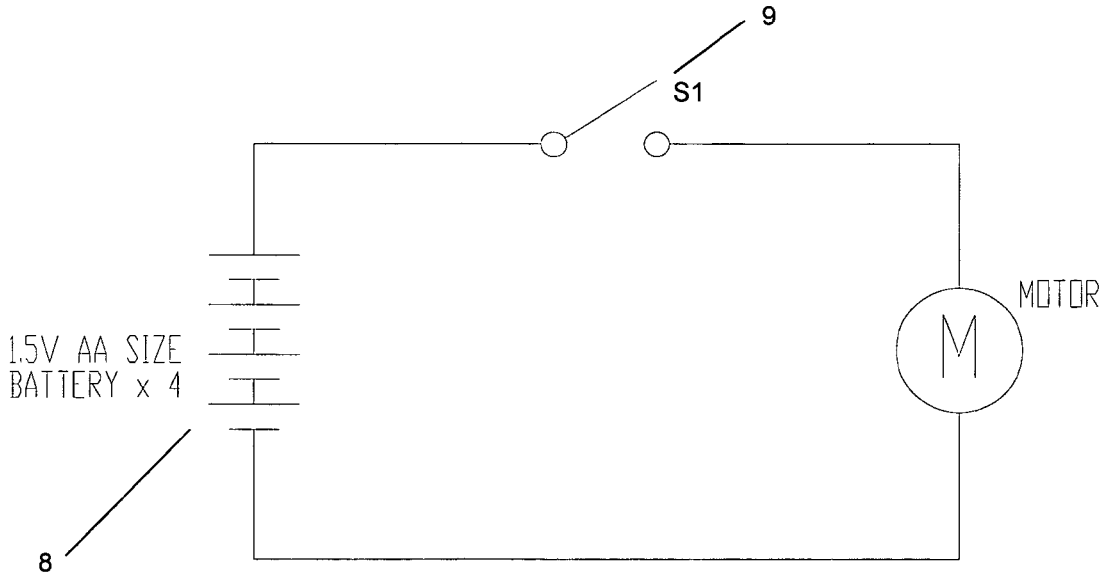
FIG. 4 shows the circuit diagram of the first embodiment of the present invention.

The present invention is further described in detail with the following embodiments and the accompanying drawings. As illustrated in FIGS. 1 and 4, the first embodiment of the present invention comprises a casing I composed of an upper casing 11 and a lower casing 12, a motor 2, vanes 3, a suction opening 4, a vent 5, a tubular suction mouth 6, a clamping member 7, a power supply 8, a switch 9 and so on. In this embodiment, the power supply 8 is four 1.5 volts AA batteries disposed in a battery box inside the casing 1. The power supply 8, the motor 2 and the switch 9 are electrically connected. The vanes 3 are fixed on a motor axis 21 and the suction opening 4 corresponds to the vanes 3 and is disposed in the front thereof. The suction mouth 6 is exposed out the casing 1, and the rear end of the suction mouth 6 connects to the suction opening 4. The cross section of the suction mouth 6 is in the shape of an olive fruit, which is an oval-shaped convex closed curve in the shape of a human eve with half of the curve joining the other half and the joining points of the two halves forming two corners being two angles resembling a pair of sguare brackets, and the diagonal joining the corners of the olive-shaped suction mouth 6 is inclined at an angle of 45" to the horizon. The cross section of the suction mouth 6 is of olive shape, so that the zipping strips can be easily pressed and sealed and that the gap between the zipping strips and the suction mouth can be reduced, thereby increasing the suction efficiency.

The clamping member 7 connects to the casing 1. It extends from the casing 1 along the tubular wall of the suction mouth 6 and surrounds one of the olive-shaped corners of the suction mouth 6, forming a clamping gap with the suction mouth 6. The suction mouth 6 is longer than the clamping gap. The width and length of the clamping gap are adapted to receive an average zipper bag. The clamping member 7 comprises an upper clamping member 71 and a lower clamping member 72 which are disposed substantially parallel to each other. In between the two, there is a clamping gap opening 73. The clamping gap opening 73 corresponds to the olive-shaped corner of the suction mouth 6, and the width of the clamping gap opening 73 is 3 mm. The width and length of the clamping gap opening 73 are adapted to press and seal the zipping strips of an average zipper bag. A plurality of ridges is disposed on the upper clamping member 71 and the lower clamping member 72 respectively on the sides facing the clamping gap opening 73. Grooves are applicable in place of ridges (not shown in the drawings). In this embodiment, a handle 74 is disposed on the clamping member 7. The handle 74 connects to the upper clamping member 71 and the lower clamping member 72. The handle 74 pivotally connects to the casing 1 through a pivot 75. The handle 74 rotates corresponding to the casing 1 on the pivot 75 and actuates the upper clamping member 71 and the lower clamping member 72 to rotate simultaneously, so as to move the clamping member 7 towards or away from the suction mouth 6, thereby adjusting the width of the clamping gap. A spring 76 is also disposed on the clamping member 7. The spring 76 moves the clamping member 7 away from the suction mouth 6 when it is in a released position and moves the clamping member 7 towards the suction mouth 6 when it is in a compressed position. In other embodiments (not shown in the drawings), the clamping member 7 may movably connects to the casing 1 and the clamping member 7 can rotate corresponding to the casing 1 so as to move towards or away from the suction mouth 6, thereby adjusting the width of the clamping gap. The upper clamping member 71 and the lower clamping member 72 can also movably connect to the casing 1 separately and the upper clamping member 71 and the lower clamping member 72 can rotate corresponding to the casing 1 separately, so as to move towards or away from the suction mouth 6, thereby adjusting the width of the clamping gap.

In this embodiment, the handle 74 also serves as a switch. When the handle 74 is driven to move the clamping member 7 towards the position of the suction mouth 6, the switch 9 is turned on to drive the motor 2 to make the vanes 3 rotate to proceed vacuuming.

Figure 2:
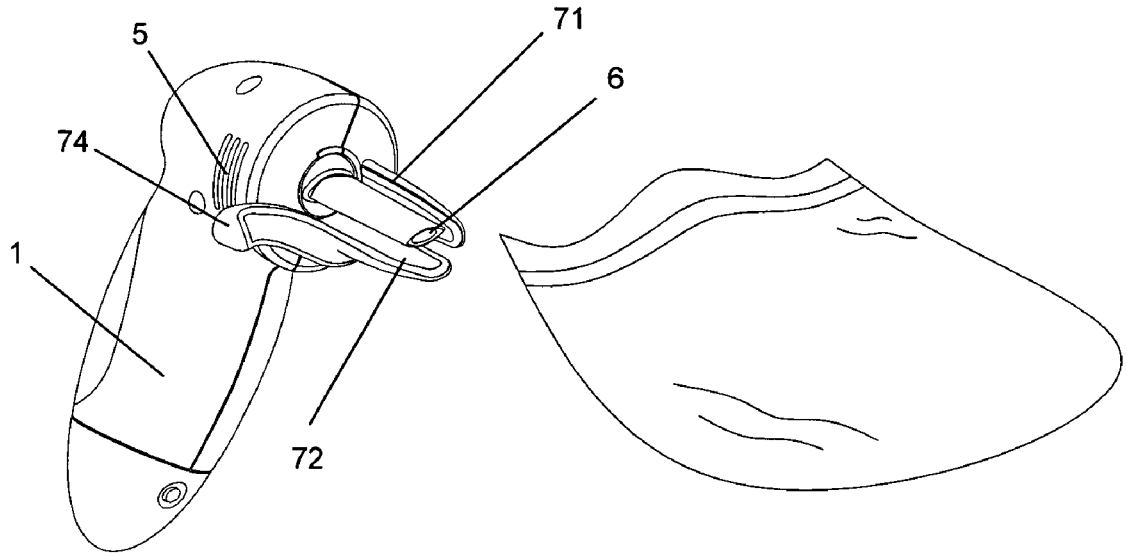
FIG. 2 shows the first embodiment of the present invention in its default position before sealing.
Figure 3:
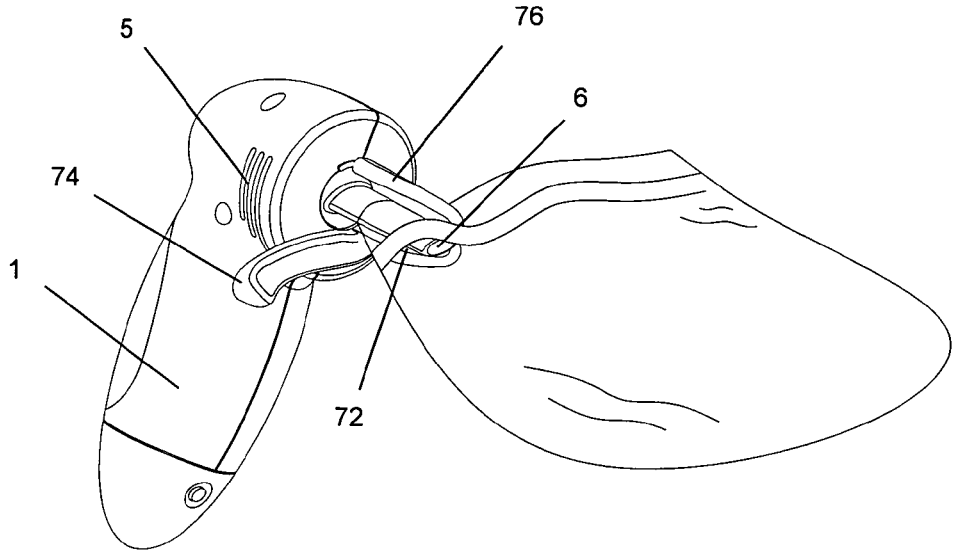
FIG. 3 shows the first embodiment of the present invention in its sealed position.

As illustrated in FIGS. 2 and 3, to use the present invention, users may insert one end of the zipper bag opening into the clamping gap in between the suction mouth 6 and the clamping member 7 and ensure that the ends of the zipping strips of the bag opening is disposed inside the clamping gap opening 73 as in FIG. 2. Then, drive the handle 74 to a position that moves the clamping member 7 towards the suction mouth 6, so that the switch 9 is turned on to drive the motor 2 to make the vanes 3 rotate to proceed vacuuming. At the same time, pull the present invention in the direction towards the suction mouth 6, and the clamping gap opening 73 will press and seal the zipping strips. When the suction mouth 6 reaches the other end of the bag opening as in FIG. 3, ensure that air inside the bag is all drawn out and then remove the suction mouth 6 and press and seal the rest of the zipping strips.

Figure 5:
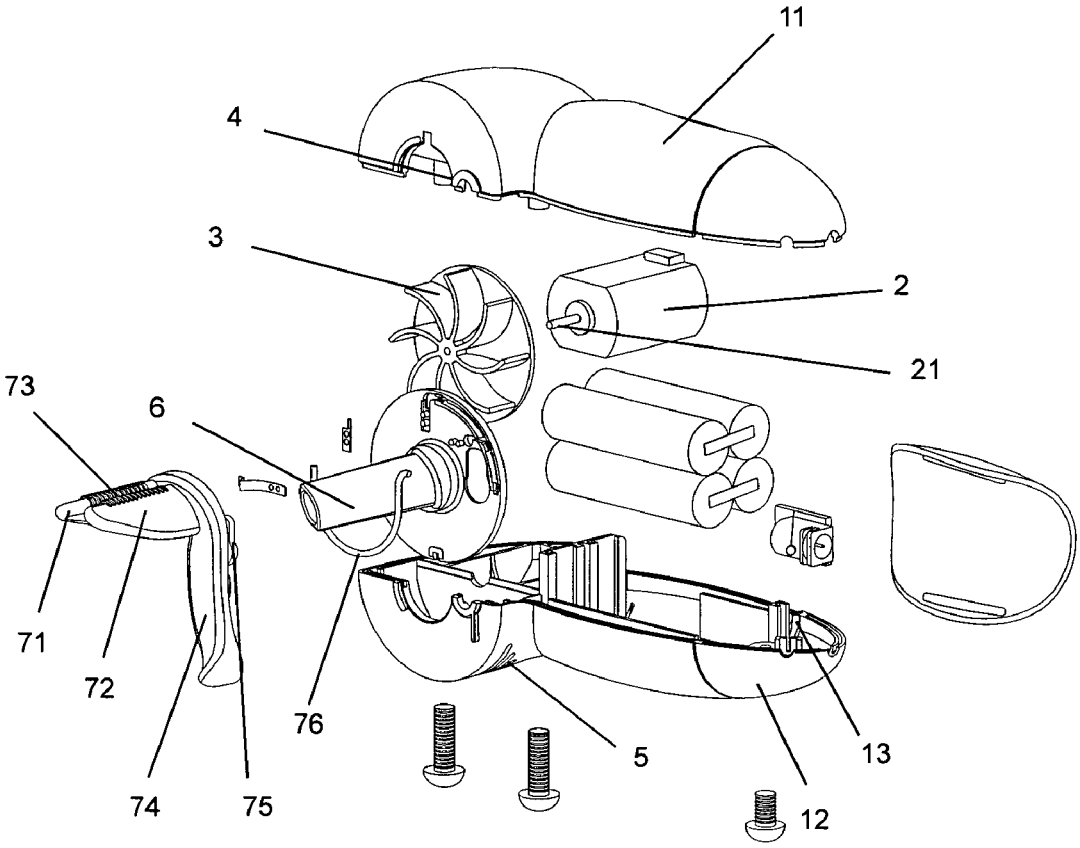
FIG. 5 shows the dismantling view of the second embodiment of the present invention.
Figure 6:
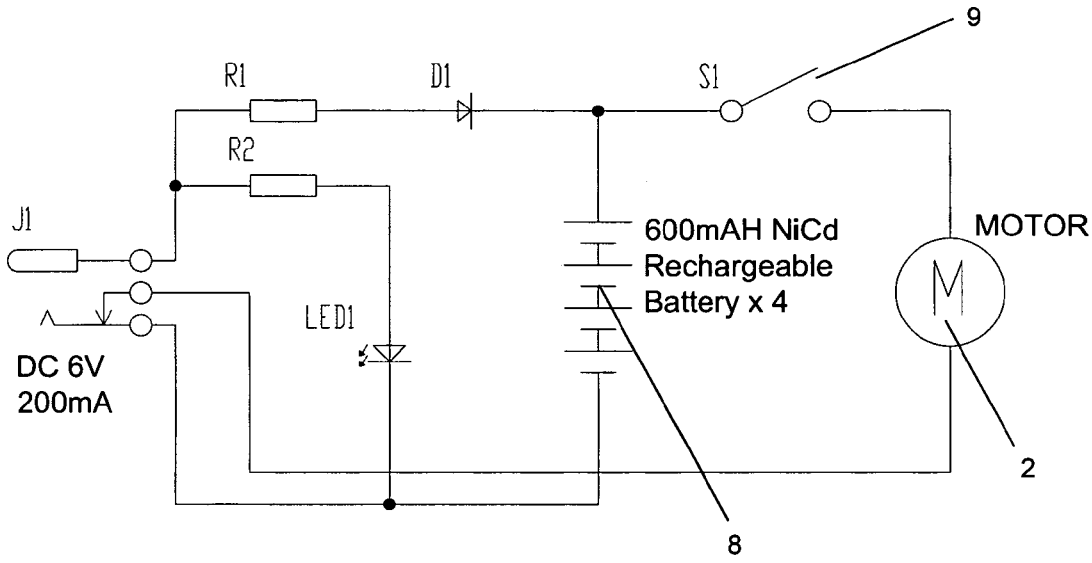
FIG. 6 shows the circuit diagram of the second embodiment of the present invention.

FIGS. 5 and 6 illustrate the second embodiment of the present invention. The structure of this embodiment is generally the same as that of the first embodiment, with the exception that the power supply 8 is rechargeable batteries. The rechargeable batteries connect to a recharging plug. A socket 13 is disposed on the casing 1 corresponding to the recharging plug.

Figure 7:
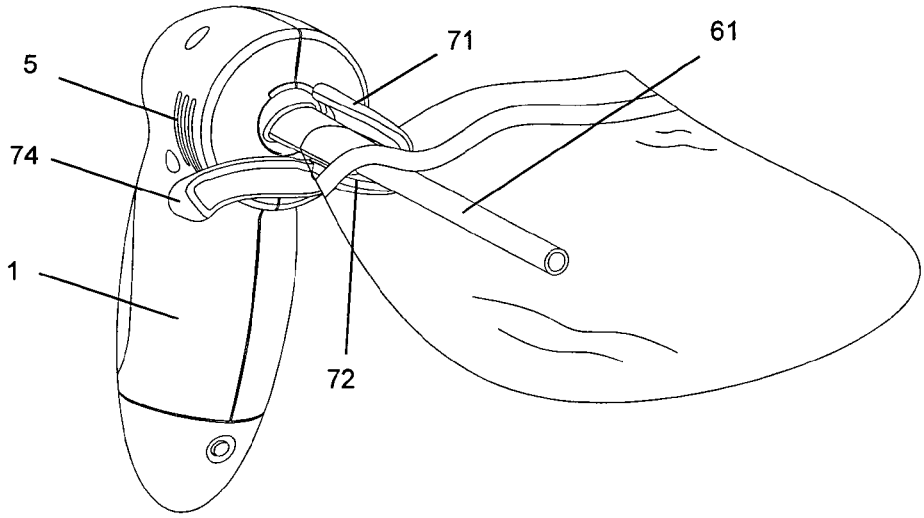
FIG. 7 shows the perspective view of the third embodiment of the present invention.

FIG. 7 shows the third embodiment of the present invention. The structure of this embodiment is generally the same as that of the first embodiment, with the exception that the suction mouth 6 movably connects to a suction tube 61. The length of the suction tube 61 may vary with the size of the zipper bag 10. Preferably, the bottom of the suction tube 61 is disposed closely with the bottom of the zipper bag 10, so as to facilitate suction of air from the bottom of the zipper bag 10, thereby attaining better vacuuming effect.

What is claimed is:

1. A vacuum machine for zipper bag comprising a casing, a motor, vanes, a suction mouth, a suction opening, a vent, a power supply and a switch; the power supply, the motor and the switch are electrically connected; the vanes are fixed on an axis of the motor; the suction opening is disposed corresponding to the vanes; the suction mouth is of tubular shape and is exposed out of the casing, and the rear end of which connects to the suction opening, wherein the machine also comprises a clamping member that connects with the casing and surrounds a section of the suction mouth; a clamping gap is formed between the clamping member and the suction mouth; the clamping member comprises an upper clamping member and a lower clamping member which are disposed substantially parallel to each other, thereby forming a clamping gap opening, the width of which is between 2 mm and 5 mm; a plurality of ridges or grooves is disposed on the upper clamping member and the lower clamping member respectively on the sides facing the clamping gap opening.

2. The vacuum machine for zipper bag as in claim 1, wherein the cross section of the suction mouth is in the shape of an olive fruit, which is an oval-shaped convex closed curve in the shape of a human eye with half of the curve joining the other half and the joining points of the two halves forming two corners being two angles resembling a pair of square brackets.

3. The vacuum machine for zipper bag as in claim 2, wherein a diagonal joining the two corners of the cross section of the suction mouth is inclined at an angle of 45° in relation to the horizon.

4. The vacuum machine for zipper bag as in claim 3, wherein the clamping member extends from the casing along the wall of the suction mouth and surrounds one of the two corners of the suction mouth, and the clamping gap opening corresponds to that corner.

5. The vacuum machine for zipper bag as in claim 1, 2, 3 or 4, wherein the clamping member movably connects to the casing and the clamping member can rotate corresponding to the casing so as to move towards or away from the suction mouth, thereby adjusting the width of the clamping gap.

6. The vacuum machine for zipper bag as in claim 1, 2, 3 or 4, wherein the upper clamping member and the lower clamping member movably connect to the casing separately; the upper clamping member and the lower clamping member can rotate corresponding to the casing separately so as to move towards or away from the suction mouth, thereby adjusting the width of the clamping gap.

7. The vacuum machine for zipper bag as in claim 1, 2, 3 or 4, wherein a handle is disposed on the clamping member; the handle connects to the upper clamping member and the lower clamping member; the handle connects to a pivot of the casing; the handle rotates corresponding to the casing on the pivot and actuates the upper clamping member and the lower clamping member to rotate simultaneously, so as to move towards or away from the suction mouth, thereby adjusting the width of the clamping gap.

8. The vacuum machine for zipper bag as in claim 1, 2, 3 or 4, wherein a spring is disposed on the clamping member; the spring moves the clamping member away from the suction mouth when it is in a released state and moves the clamping member towards the suction mouth when it is in a compressed state.

9. The vacuum machine for zipper bag as in claim 1, wherein the suction mouth is longer than the clamping gap.

10. The vacuum machine for zipper bag as in claim 1, wherein the suction mouth movably connects to a suction tube.

11. The vacuum machine for zipper bag as in claim 1, wherein the power supply is dry batteries or rechargeable batteries.

* * * * *